United States Patent [19]

Okada et al.

[11] Patent Number: 4,742,811

[45] Date of Patent: May 10, 1988

[54] IGNITION CONTROL SYSTEM FOR INTERNAL COMBUSTION ENGINES

[75] Inventors: Yasushi Okada; Iwao Shimane, both of Wako, both of Japan

[73] Assignee: Honda Giken Kogyo K.K., Tokyo, Japan

[21] Appl. No.: 98,016

[22] Filed: Sep. 17, 1987

[30] Foreign Application Priority Data

Oct. 23, 1986 [JP] Japan ..... 61-252752

[51] Int. Cl.[4] ..... F02P 3/04; F02P 1/00; F02P 23/00

[52] U.S. Cl. ..... 123/643; 123/617

[58] Field of Search ..... 123/643, 617, 601, 602, 123/612

[56] References Cited

U.S. PATENT DOCUMENTS

| | | | |
|---|---|---|---|
| 3,202,146 | 8/1965 | Short et al. | 123/643 |
| 3,880,132 | 4/1975 | Whatley, Jr. | 123/643 |
| 4,235,213 | 11/1980 | Jellissen | 123/617 |
| 4,313,414 | 2/1982 | Planteline | 123/612 |
| 4,378,004 | 3/1983 | Petrie | 123/643 |
| 4,416,245 | 11/1983 | Taft et al. | 123/617 |
| 4,664,092 | 5/1987 | Kaufmann | 123/643 |
| 4,686,953 | 8/1987 | Brown | 123/643 |
| 4,690,124 | 9/1987 | Higashiyama | 123/643 |

*Primary Examiner*—Raymond A. Nelli

*Attorney, Agent, or Firm*—Arthur L. Lessler

[57] ABSTRACT

An ignition timing control system for an internal combustion engine comprises first signal generating means for generating a first signal at a crank angle position of the engine corresponding to each one of a plurality of cylinder groups; second signal generating means for generating a second signal at a crank angle position corresponding to a top-dead-center position of each cylinder, and distributing means for distributing ignition command signals to ignition devices provided for respective cylinder groups, in response to the first and second signals. Further, cylinder-discriminating means is provided for generating a third signal at a crank angle position corresponding to a particular one of the cylinders in response to the first and second signals.

6 Claims, 5 Drawing Sheets

IGNITION CONTROL SYSTEM FOR INTERNAL COMBUSTION ENGINES

BACKGROUND OF THE INVENTION

This invention relates to a distributorless ignition control system for an internal combustion engine having a plurality of cylinders.

Conventionally, there has been proposed a low-cost simultaneous ignition-type ignition device for internal combustion engines, which has no distributor and is adapted to effect ignition in all the cylinders on different strokes at the same time (e.g. Japanese Provisional Patent Publications Nos. 55-22845 and 55-37536).

In such a distributorless ignition device, a particular one of the cylinders is discriminated by electronic descriminating means in order to effect ignition in the cylinders in predetermined sequence and at proper timing. The conventional electronic discriminating means comprises a cylinder-discriminating sensor formed of an electromagnetic pickup disposed to generate a cylinder-discriminating signal at a crank angle position corresponding to the particular cylinder. Ignition is started from a group of cylinders to which the particular cylinder belongs when the cylinder-discriminating signal is generated. However, if the engine is started with the crankshaft positioned slightly behind the crank angle position corresponding to the particular cylinder, the first cylinder-discriminating signal is not generated immediately upon starting of the engine. Consequently, ignition is not commenced immediately upon the engine starting, resulting in delayed commencement of the engine firing.

SUMMARY OF THE INVENTION

It is a first object of the invention to provide an ignition control system for internal combustion engines, which is capable of commencing the ignition immediately upon starting of the engine without delay irrespective of the initial crank angle position assumed immediately before the start of the engine.

It is a second object of the invention to provide an ignition control system for internal combustion engines, which is adapted to discriminate a particular cylinder without the use of a special cylinder-discriminating sensor, whereby the sensing means for sensing the crank angle position of the engine can be simplified in structure and reduced in manufacturing cost.

To attain the first object, the present invention provides an ignition control system for an internal combustion engine having a plurality of groups of cylinders and a plurality of ignition devices provided for respective ones of the groups of cylinders, the system comprising: first signal generating means for generating a first signal at a crank angle position of the engine corresponding to each one of the groups of cylinders; second signal generating means for generating a second signal at a crank angle position of the engine corresponding to a top-dead-center position of each one of the cylinders; and distributing means for distributing ignition command signals to the ignition devices, in response to the first and second signals.

Preferably, the above first signal generating means and second signal generating means comprise a rotary element disposed to be rotatively driven by the engine and having an outer peripheral surface thereof magnetized with a predetermined magnetic pattern adapted to generate the first and second signals, and sensing means formed of Hall elements arranged opposite the outer peripheral surface of the rotary element.

Also preferably, the distributing means comprises means for generating a signal indicative of predetermined fixed ignition timing, in response to which the ignition command signals are generated.

To attain the second object, the present invention provides an ignition control system for an internal combustion engine having a plurality of groups of cylinders, comprising: first signal generating means for generating a first signal at a crank angle position of the engine corresponding to each one of the groups of cylinders; second signal generating means for generating a second signal at a crank angle position of the engine corresponding to a top dead center position of each one of the cylinders; and cylinder-discriminating means for generating a third signal at a crank angle position of the engine corresponding to a particular one of the cylinders in response to the first and second signals.

Preferably, the first signal has a pulse train generated at a crank angle position of the crank shaft corresponding to the top-dead-center position of the particular cylinder, the second signal having a pulse falling after generation of the pulse train. The cylinder-discriminating means comprises counter means for counting pulses of the pulse train, the counter means being reset in response to falling of the pulse of the second signal, the counter means generating a predetermined signal when counting up the pulses of the pulse train, and decoder means responsive to the predetermined signal for generating the third signal.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
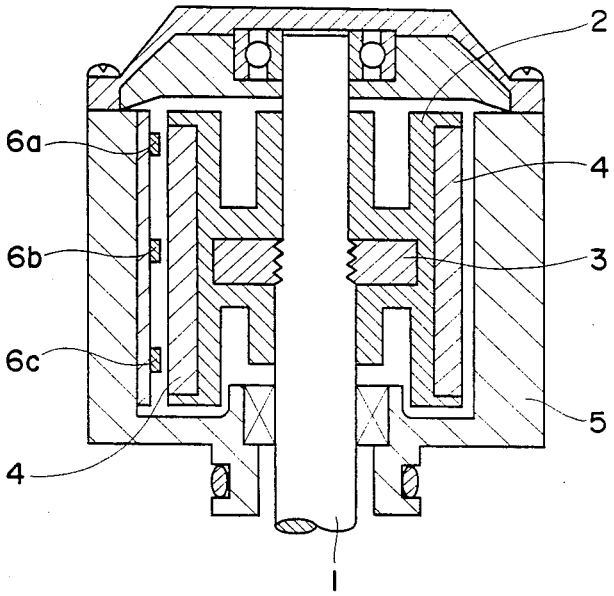
FIG. 1 is a longitudinal sectional view of a sensor means for sensing the rotational angle of the crankshaft of an internal combustion engine.

Referring first to FIG. 1, there is illustrated a sensor means for magnetically sensing the rotational angle of a crankshaft, not shown, of an internal combustion engine. In the figure, reference numeral 1 designates a rotary shaft which is disposed to make one rotation (i.e. through 360 degrees) while the crankshaft makes two rotations (i.e. through 720 degrees), and which is coupled to a camshaft, not shown, of the engine to be rotatively driven thereby. A rotating element 2 is secured on the rotary shaft 1 by means of a dowel pin 3 for rotation in unison with the rotary shaft 1. Fitted on the rotating element 2 is a magnetic drum 4 which has its outer peripheral surface magnetized with a predetermined magnetic pattern, as described later. The rotary shaft 1, the rotating element 2 and the magnetic drum 4 are rotatably fitted in a cylindrical casing 5 which has its inner peripheral surface provided with three Hall element sensors *6a, 6b,* and *6c* at a predetermined circumferential location and longitudinally arranged at equal intervals, for sensing the rotational angle position of the magnetic drum 4, i.e. the crank angle position of the engine.

Figure 2:
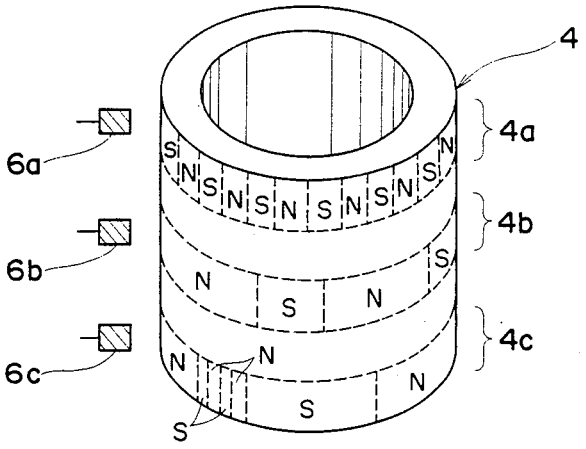
FIG. 2 is a perspective view of a magnetic drum appearing in FIG. 1, showing an imaginary magnetic pattern magnetized over the outer peripheral surface of the drum.

FIG. 2 shows the imaginary magnetic pattern over the outer peripheral surface of the magnetic drum 4 in FIG. 1. The outer peripheral surface of the magnetic drum 4 is divided into three columns, i.e. an upper column *4a*, an intermediate column *4b*, and a lower column *4c*. Each column comprises a plurality of north pole portions N (hereinafter called "N pole") and a plurality of south pole portions S (hereinafter called "S pole"), which are circumferentially arranged alternately with each other. The aforesaid Hall element sensors *6a, 6b,* and *6c* are arranged opposite the respective columns *4a, 4b,* and *4c* and adapted to generate a high-level signal when it passes by each N pole of its corresponding column, and a low-level signal when it passes by each S pole thereof, respectively.

To be specific, the upper column *4a* has totally twenty four N poles and S poles arranged alternately with each other at regular intervals. During rotation of the engine, the Hall element sensor *6a* opposite the upper column *4a* generates a crank angle signal $T_{24}$ which alternately rises and falls each time the crankshaft rotates through 30 degrees [(b) of FIG. 4].

The intermediate column *4b* has totally eight N poles and S poles arranged alternately with each other at regular intervals. During rotation of the engine, the Hall element sensor *6b* opposite the intermediate column *4b* generates a TDC signal $T_{04}$ at a crank angle position corresponding to a top-dead-center position (TDC) of each cylinder each time the crankshaft rotates through 180 degrees [(b) of FIG. 4].

The lower column *4c* has totally four N poles and S poles arranged alternately with each other. During rotation of the engine, the Hall element sensor *6c* opposite the lower column *4c* generates a cylinder group-discriminating signal $T_{02}$ which goes high or low at a crank angle position corresponding to TDC position of each cylinder group [(c) of FIG. 4].

A particular one of the N poles of the lower column *4c* has a rear end portion circumferentially divided into four small subdivided portions arranged at equal intervals and magnetized with alternately arranged different polarities, i.e. alternately arranged N poles and S poles, such that an auxiliary signal $T_2$ is obtained which rises two times while the aforesaid signal $T_{04}$ is maintained at a high level at the crank angle position corresponding to the particular cylinder. The cylinder group-discriminating signal $T_{02}$ and the auxiliary signal $T_2$ are hereinafter called together "$T_{02+2}$" [(c') of FIG. 4].

The arrangement and operation of the ignition control system according to the invention will now be explained with reference to FIGS. 3 and 4.

Figure 3:
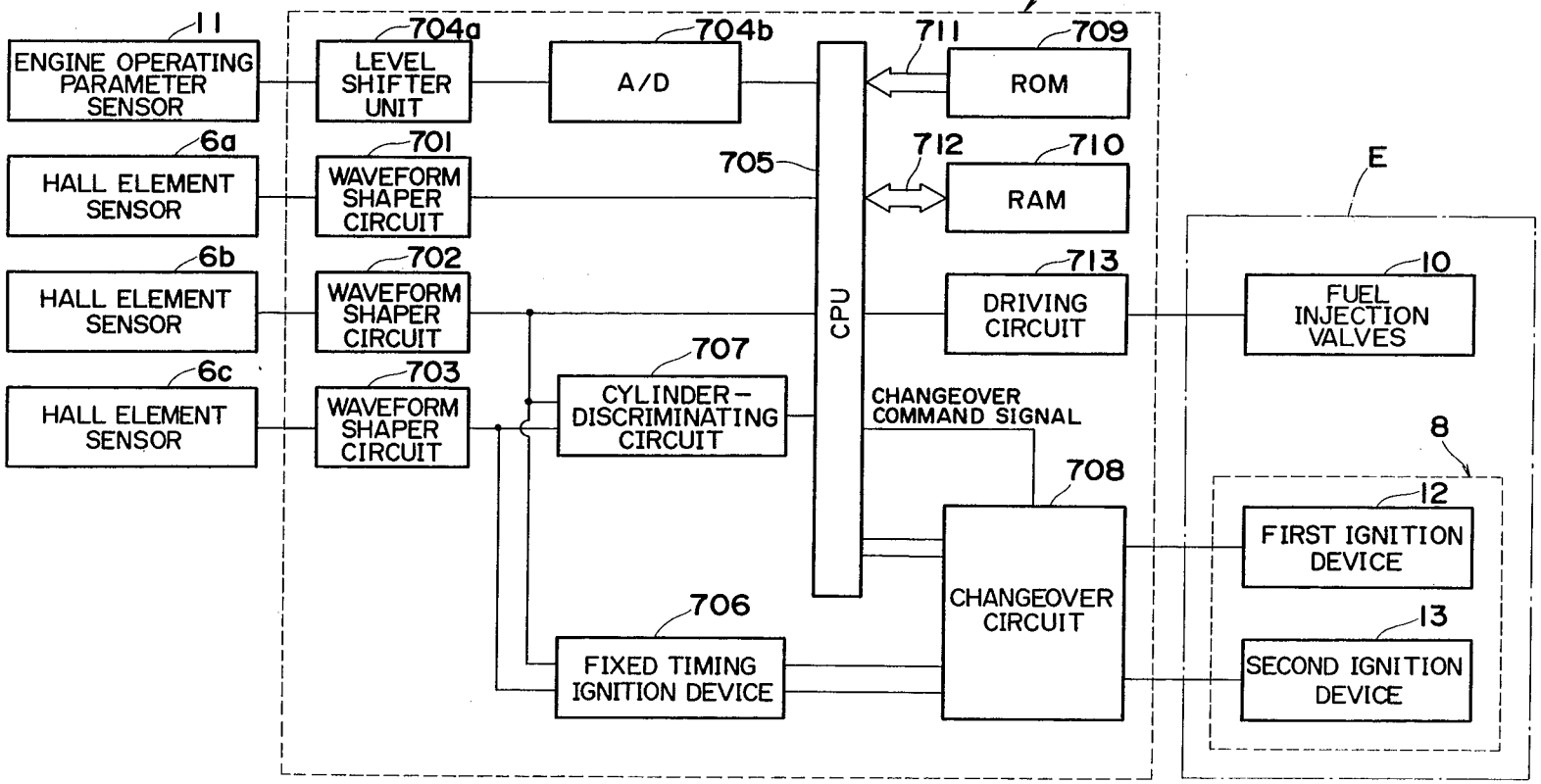
FIG. 3 is a block diagram illustrating the whole arrangement of an electronic control system in which is incorporated an ignition control system according to the invention.
Figure 4:
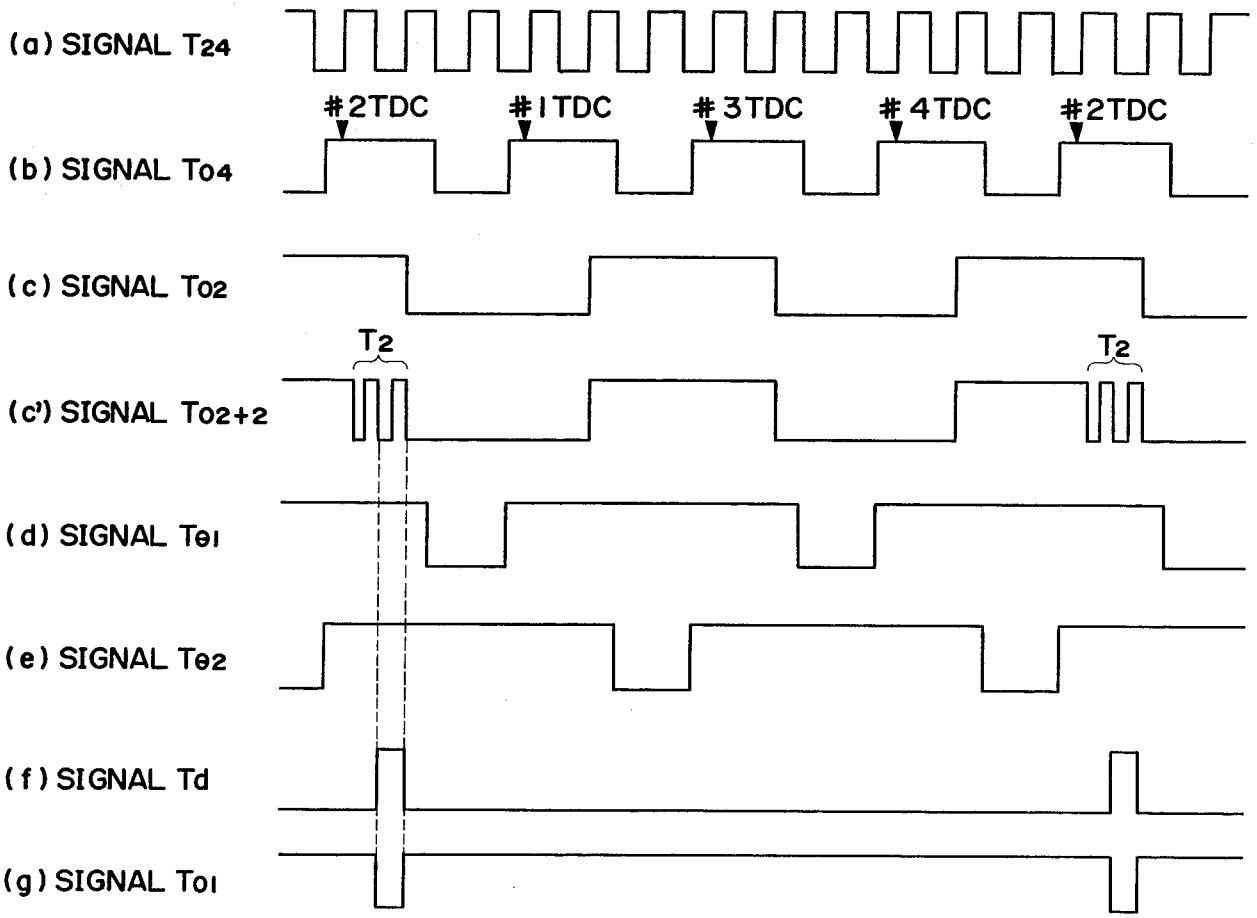
FIG. 4 is a timing chart of various signals obtained in the electronic control system of FIG. 3.
Figure 5:
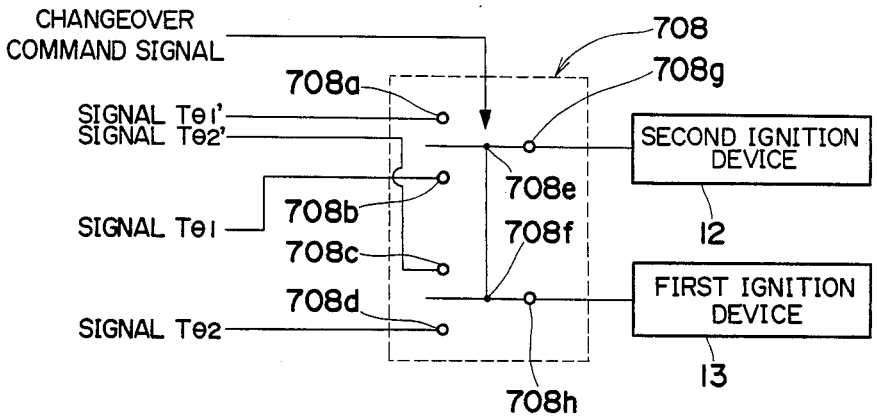
FIG. 5 is a view showing the internal arrangement of a changeover circuit appearing in FIG. 3.

Referring first to FIG. 3, there is shown the whole arrangement of an electronic control system (ECU) 7 for an internal combustion engine E having two cylinder groups each formed of two cylinders, in which is incorporated the ignition control system according to the invention. The crank angle position signal $T_{24}$ from the Hall element sensor *6a* is supplied to a waveform shaper circuit 701 within the ECU 7 to have its waveform shaped, and the shaped signal is supplied to a central processing unit (hereinafter called "CPU") 705. The signal $T_{24}$ is used as a timing signal in calculation of the ignition timing and ignition coil energization timing within the CPU 705. The TDC signal from the Hall element sensor *6b* has its waveform shaped by a waveform shaper circuit 702 and the shaped signal is supplied to the CPU 705, as well as to a fixed timing ignition device 706 as ignition command signal-distributing means and a cylinder-discriminating device 707 as cylinder-discriminating means. The cylinder group-discriminating signal $T_{02+2}$ from the Hall element sensor *6c* has its waveform shaped by a waveform shaper circuit 703 and the shaped signal is supplied to the cylinder-discriminating device 703.

The fixed timing ignition device 706 is responsive to the signal $T_{04}$ and the signal $T_{02+2}$ for generating a signal indicative of predetermined ignition timing for each cylinder group, as hereinafter described in detail, and supplying the signal to a changeover circuit 708.

The cylinder-discriminating device 707 is responsive to the signals $T_{04}$, $T_{02+2}$ for generating a cylinder-discriminating signal $T_{01}$ and supplying same to the CPU 705.

Analog signals from engine operating parameter sensors 11 such as an intake pipe absolute pressure sensor and an engine temperature sensor have their output levels shifted to a predetermined voltage level by a level shifter unit *704a*, the level shifted signals are successively converted into digital signals by an A/D converter *704b*, and the digital signals are supplied to the CPU 705.

Connected to the CPU 705 are a read only memory (ROM) 709 via a data bus 711, and a random access memory (RAM) 710 via a data bus 712, respectively. The ROM 709 stores various control programs executed within the CPU 705, etc. and the RAM 710 temporarily stores results of various calculations executed within the CPU 705.

The CPU 705 calculates the ignition timing and ignition coil energization timing of each cylinder group by means of predetermined arithmetic expressions based upon output signals from the aforesaid engine operating parameter sensors 11, the Hall element sensors *6a, 6b,* and *6c*, and the cylinder-discriminating device 707, and supplies a variable ignition timing command signal indicative of the calculated ignition timing and coil energization timing to the changeover circuit 708. The CPU 705 also calculates the valve opening period of fuel injection valves 10 based upon various operating parameters, and supplies a valve opening command signal indicative of the calculated valve opening period to a driving circuit 713.

The CPU 705 determines whether or not the engine is operating in a predetermined operating condition wherein fixed timing ignition is required such as at the start of the engine and during very low speed operation of the engine, from output signals from the aforesaid engine operating parameter sensors 11, and it supplies a changeover command signal depending upon the result of the determination to the changeover circuit 708 to select one of ordinary or variable timing ignition control based upon calculation by the CPU 705 and fixed timing ignition control carried out by the fixed timing ignition device 706.

An ignition device 8 of the engine E is a simultaneous ignition type and comprises first and second ignition devices 12 and 13, the former igniting a first group of cylinders, referred to hereinafter, and the latter a second group of cylinders, also referred to hereinafter, respectively.

Details of the ignition device 8 of the simultaneous ignition type will be explained. In a four cylinder type internal combustion engine, usually sequential ignition is carried out such that a first cylinder, a third cylinder, a fourth cylinder, and a second cylinder are sequentially ignited in the mentioned order. On the other hand, in an ignition device of the simultaneous ignition type which has been developed for the purpose of making the device compact in size, the four cylinders are divided into a first group (in which either the compression stroke or the exhaust stroke is terminated upon rising of the signal $T_{04}$) and a second group (in which either the compression stroke or the exhaust stroke is terminated upon the next rising of the signal $T_{04}$). The first and second groups of cylinders are ignited alternately with each other at each generation of the signal $T_{04}$. Thus, according to the simultaneous ignition type, each cylinder is ignited not only immediately before termination of its compression stroke but also immediately before termination of its exhaust stroke, but since fuel has not been charged into the cylinder immediately before termination of the exhaust stroke, the engine operation is not adversely affected by the ignition taking place immediately before termination of the exhaust stroke.

The changeover circuit 708 supplies either the variable timing ignition command signal from the CPU 705 or the fixed timing ignition command signal from the fixed timing ignition device 706 to the first and second devices 12, 13, depending upon the changeover command signal from the CPU 705.

To be specific, the changeover circuit 708 has input terminals **708*a* and 708*c* supplied, respectively, with signals $T_{\theta 1'}$ and $T_{\theta 2'}$ indicative, respectively, of variable ignition timing values of the first and second cylinder groups, and output terminals 708*b* and 708*d* supplied, respectively, with signals $T_{\theta 1}$ and $T_{\theta 2}$ indicative, respectively, of fixed ignition timing values of the first and second cylinder groups from the fixed timing ignition device 706. When the engine is brought into a predetermined operating condition such as at the start of the engine E and during very low speed operation of the engine, the changeover circuit 708 is actuated by the changeover command signal from the CPU 705 to connect output terminals 708*g* and 708*h*, respectively, with the input terminals 708*a*, 708*c* by means of switches 708*e* and 708*f*. When the engine E is not operating in the predetermined operating condition, the changeover circuit 708 is actuated by the changeover command signal to connect the output terminals 708*g*, 708*h*, respectively, with the input terminals 708*b*, 708*d* by means of the switches 708*e*, 708*f*. The output terminals 708*g*, 708*h* are connected, respectively; with the first and second ignition devices 12, 13 so that these ignition devices are controlled by the respective output signals (the ignition command signals) from the output terminals 708*g*, 708*h***.

Next, the arrangement and operation of the fixed timing ignition device 706 will be explained in detail.

Figure 6:
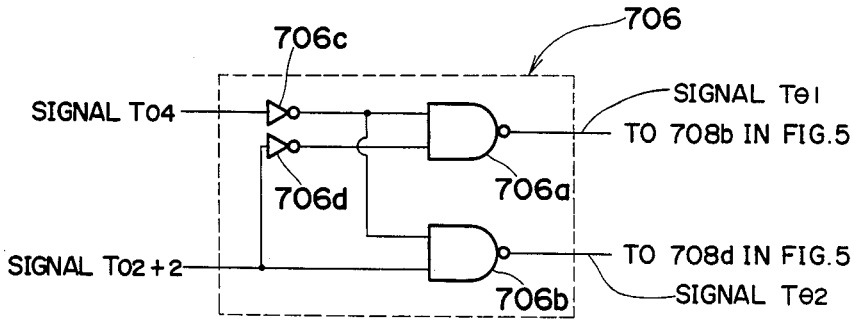
FIG. 6 is a view showing the internal arrangement of a fixed timing ignition device appearing in FIG. 3.

As shown in FIG. 6, the fixed timing ignition device 706 comprises two NAND circuits **706*a* and 706*b*, and invertors 706*c* and 706*d*. The NAND circuit 706*a* has one input terminal supplied with the signal $T_{04}$ shown at (b) of FIG. 4 from the Hall element sensor 6*b* through the waveform shaper circuit 702 and the invertor 706*c*, and the other input terminal supplied with the signal $T_{02+2}$ shown at (c') of FIG. 4 from the Hall element sensor 6*c* through the waveform shaper circuit 703 and the invertor 706*d*, while an output signal from the NAND circuit 706*a* is applied to the input terminal 708*b* of the changeover circuit 708. The NAND circuit 706*b* has one input terminal supplied with the signal $T_{04}$ and the other input terminal supplied with the signal $T_{02+2}$ shown at (c') of FIG. 4, while an output signal from the NAND circuit 706*b* is applied to the input terminal 708*d* of the changeover circuit 708**.

The NAND circuit **706*a* supplies the ignition command signal $T_{\theta 1}$ for commanding ignition of the first cylinder group. The output $T_{\theta 1}$ from the NAND circuit 706*a* goes low (Lo) only when the signal $T_{04}$ is at a low level (Lo) and at the same time the signal $T_{02+2}$ from the Hall element sensor 6*c* is at a low level (Lo) as seen in a table given below. The low output from the NAND circuit 706*a* serves as the ignition command signal $T_{\theta 1}$ shown at (d) of FIG. 4** which indicates fixed ignition timing of the first cylinder group.

The NAND circuit **706*b* supplies the ignition command signal $T_{\theta 2}$ for commanding ignition of the second cylinder group. The output $T_{\theta 2}$ from the NAND circuit 706*b* goes low (Lo) only when the signal $T_{04}$ is at a low level (Lo) and at the same time the signal $T_{02+2}$ from the Hall element sensor 6*c* is at a high level (Hi), as seen in the table given below. The low output from the NAND circuit 706*b* serves as the ignition command signal $T_{\theta 2}$ shown at (e) of FIG. 4** which indicates fixed ignition timing of the second cylinder group.

The signals $T_{\theta 1}$ and $T_{\theta 2}$ thus distributed by the fixed timing ignition device 706 are applied, respectively, to the input terminals **708*b*, 708*d* of the changeover circuit 708. As stated before, when the engine is operating in the predetermined operating condition such as at the start of the engine and during very low speed operation of the engine, these signals are selected by the changeover circuit 708 and supplied, respectively, to the first and second ignition devices 12, 13. The first and second ignition devices 12, 13** start energizing the respective ignition coils, not shown, upon rising of the respective signals $T_{\theta 1}$, $T_{\theta 2}$, and cause discharging of the coils upon falling of the signals, i.e. ignition.

TABLE

| $T_{04}$ | $T_{02+2}$ | $T_{\theta 1}$ | $T_{\theta 2}$ |
|---|---|---|---|
| Hi | Hi | Hi | Hi |
| Hi | Lo | Hi | Hi |
| Lo | Hi | Hi | Lo |
| Lo | Lo | Lo | Hi |

Therefore, according to the fixed timing ignition control of the invention, even when the particular cylinder is not yet discriminated immediately after the start of the engine, the ignition command signal $T_{\theta 1}$, $T_{\theta 2}$ for each cylinder group is obtained from the signal $T_{04}$, $T_{02+2}$ which are generated immediately upon starting of the engine, the ignition can be positively started without delay immediately upon starting of the engine.

The arrangement and operation of the cylinder-discriminating device 707 will now be described.

Figure 7:
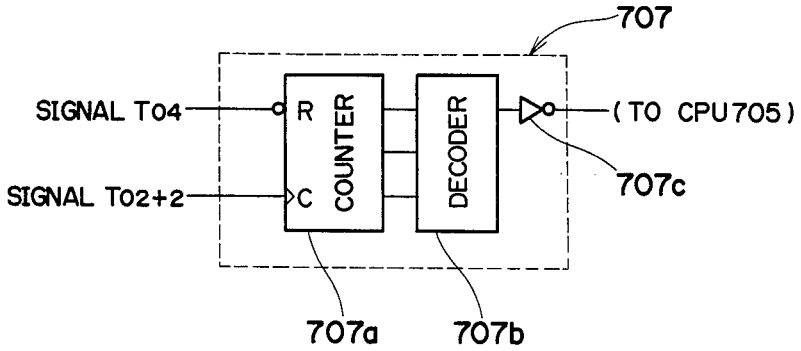
FIG. 7 is a view showing the internal arrangement of a cylinder-discriminating device appearing in FIG. 3.

The cylinder-discriminating device 707 comprises a counter 707*a*, a decoder 707*b*, and a invertor 707*c*, as shown in FIG. 7. The counter 707*a* has a reset terminal R supplied with the signal $T_{04}$ from the Hall element sensor 6*b* via the waveform shaper circuit 702, and an input terminal C supplied with the signal $T_{02+2}$ from the Hall element sensor 6*c* via the waveform shaper circuit 703. The counter 707*a* has its output terminal connected to the decoder 707*b*, which in turn has its output terminal connected to the CPU 705 by way of the invertor 707*c*.

The counter 707*a* counts the number of times of falling (i.e. trailing edges) of the signal $T_{02+2}$ supplied from the Hall element sensor 6*c* and sends the counted number to the decoder 707*b*. The counter 707*a* has its counted value reset to zero each time the trailing edge of the signal $T_{04}$ is applied to the reset terminal R.

The decoder 707*b* generates a signal $T_d$ which rises or goes high (Hi), only when the counted value from the counter 707*a* reaches 2, and falls or goes low (Lo) when the counted value reaches 3.

Figure 8:
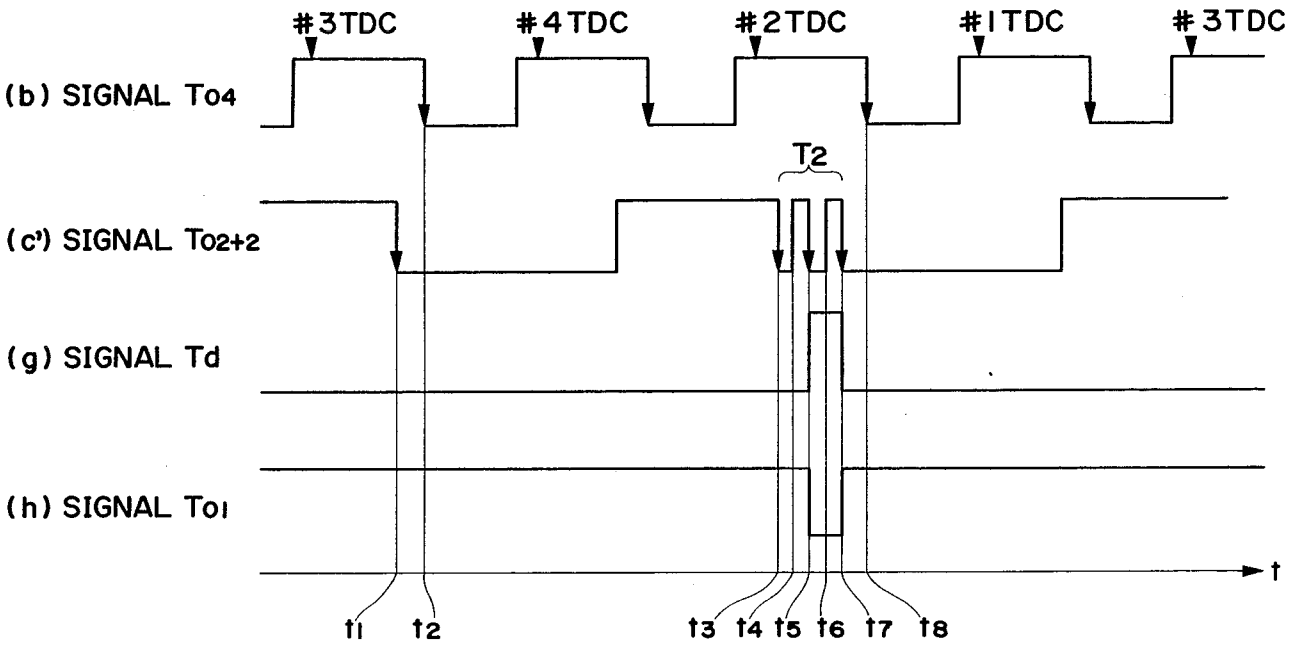
FIG. 8 is a timing chart of signals useful in showing the timing of generation of a signal $T_{04}$ from the cylinder-discriminating device of FIG. 7.

Assuming that the auxiliary signal $T_2$ corresponds to the second cylinder #2 as the particular cylinder, when the signal $T_{02+2}$ [(c') of FIG. 8] from the Hall element sensor 6*c* is inputted to the counter 707*a* as the crankshaft starts rotating, the counted value of the counter 707*a* becomes 1 at the first trailing edge of the signal $T_{02+2}$ (at a time point $t_1$ in FIG. 8). This counted value of 1 is reset to zero at a trailing edge of the signal $T_{04}$ [(b) of FIG. 8] occurring immediately after the first trailing edge of the signal $T_{02+2}$ (at a time point $t_2$ in FIG. 8) so that the signal T from the decoder 707*b* is held at low level (Lo). Then, when a further trailing edge of the signal $T_{02+2}$ is inputted to the counter 707*a* at a time point $t_3$), the counted value becomes 1. Then, in the example of FIG. 8, the signal $T_{02+2}$ rises at a time point $t_4$ and falls at a time point $t_5$. However, since the signal $T_{04}$ does not fall between $t_3$ and $t_5$, the counter 707*a* has its counted value increased to 2 without being reset and consequently the output signal $T_d$ from the decoder 707*b* becomes high (Hi) at the time point $t_5$. Then, the signal $T_{02+2}$ rises at a time point $t_6$ and falls at a time point $t_7$, but the signal $T_{04}$ does not fall between time points $t_5$ and $t_7$. As a result, the counter 707*a* has its counted value increased to 3 without being reset. Accordingly, the output signal $T_d$ from the decoder 707*b* goes low (Lo) in response to the counted value of 3. Then, a subsequent trailing edge of the signal $T_{04}$ occurring at a time point $t_8$ is applied to the reset terminal R of the counter 707*a* so that the counted value is reset to 0. Thus, the output signal $T_d$ from the decoder 707*b* rises only immediately before the TDC position of a particular cylinder (cylinder #1), as shown at (g) of FIG. 8. The high level output signal $T_d$ is inverted into a low level as the cylinder-discriminating signal $T_{01}$ as at (h) of FIG. 8 and supplied to the CPU 705.

The cylinder-discriminating signal $T_{01}$ is used in variable timing ignition control as well as fuel injection control (sequential injection control).

In this way, according to the invention, the TDC position of a particular cylinder is discriminated from the signals $T_{04}$ and $T_{02+2}$ which are used in the ignition timing control at the start of the engine, thereby making it unnecessary to employ a special sensor for discriminating the particular cylinder and hence enabling to simplify the structure of the sensing means for sensing the rotational angle of the crank angle.

Further, according to the foregoing embodiment a magnetic drum magnetized with a predetermined magnetic pattern and Hall element sensors are employed for detecting the crank angle position, which makes it possible to hold the signal levels, i.e. high level obtained by the N poles and low level obtained by the S poles over required periods of time, as well as to optionally magnetize any desired magnetic pattern so as to obtain any desired signal waveforms.

However, in place of the crank angle sensing means composed of the magnetic drum and the Hall element sensors, other type crank angle sensing means may be employed such as one composed of pickup coils and one-shot circuits.

Although the foregoing embodiment is applied to a four-cylinder type internal combustion engine, the ignition timing control system according to the invention may be applied to six-cylinder type or eight-cylinder type internal combustion engines, with similar results to those stated above.

What is claimed is:

1. An ignition control system for an internal combustion engine having a plurality of groups of cylinders and a plurality of ignition devices provided for respective ones of said groups of cylinders, comprising: first signal generating means for generating a first signal at a crank angle position of said engine corresponding to each one of said groups of cylinders; second signal generating means for generating a second signal at a crank angle position of said engine corresponding to a top-dead-center position of each one of said cylinders; and distributing means for distributing ignition command signals to said ignition devices, in response to said first and second signals.

2. An ignition control system as claimed in claim 1, wherein said first signal generating means and said second signal generating means comprise a rotary element disposed to be rotatively driven by said engine and having an outer peripheral surface thereof magnetized with a predetermined magnetic pattern adapted to generate said first and second signals, and sensing means formed of Hall elements arranged opposite said outer peripheral surface of said rotary element.

3. An ignition control system as claimed in claim 1, wherein said distributing means comprises means for generating a signal indicative of predetermined fixed ignition timing, in response to which said ignition command signals are generated.

4. An ignition control system for an internal combustion engine having a plurality of groups of cylinders, comprising: first signal generating means for generating a first signal at a crank angle position of said engine corresponding to each one of said groups of cylinders; second signal generating means for generating a second signal at a crank angle position corresponding to a top dead center position of each one of said cylinders; and cylinder-discriminating means for generating a third signal at a crank angle position of the engine corresponding to a particular one of said cylinders in response to said first and second signals.

5. An ignition control system as claimed in claim 4, wherein said first signal has a pulse train generated at a crank angle position of said engine corresponding to said top-dead-center position of said particular cylinder, said second signal having a pulse falling after generation of said pulse train, said cylinder-discriminating means comprising counter means for counting pulses of said pulse train, said counter means being reset in response to falling of said pulse of said second signal, said counter means generating a predetermined signal when counting up said pulses of said pulse train, and decoder means responsive to said predetermined signal for generating said third signal.

6. An ignition control system as claimed in claim 4, wherein said first signal generating means and said second signal generating means comprise a rotary element disposed to be rotatively driven by said engine and having an outer peripheral surface thereof magnetized with a predetermined magnetic pattern adapted to generate said first and second signals, and sensing means formed of Hall elements arranged opposite said outer peripheral surface of said rotary element.

* * * * *